US006554277B1

(12) United States Patent
Descamps et al.

(10) Patent No.: US 6,554,277 B1
(45) Date of Patent: Apr. 29, 2003

(54) POCKETED PARACHUTE GAME

(75) Inventors: Kathleen D. Descamps, Tarrytown, NY (US); Douglas A. Liebau, Highland Park, NJ (US)

(73) Assignee: Flaghouse, Inc., Hasbrouck Heights, NJ (US)

( * ) Notice: Subject to any disclaimer, the term of this patent is extended or adjusted under 35 U.S.C. 154(b) by 0 days.

(21) Appl. No.: 09/645,114

(22) Filed: Aug. 24, 2000

Related U.S. Application Data

(60) Provisional application No. 60/150,483, filed on Aug. 24, 1999, and provisional application No. 60/226,225, filed on Aug. 18, 2000.

(51) Int. Cl.[7] ..... A63B 71/02

(52) U.S. Cl. ..... 273/113; 273/109; 273/113; 273/451; 273/459

(58) Field of Search ..... 273/123 R, 109, 273/113, 115, 116, 400, 440, 441, 459; 472/49; 446/49; 2/175.1

(56) References Cited

U.S. PATENT DOCUMENTS

| | | | | | |
|---|---|---|---|---|---|
| 870,606 | A | * | 11/1907 | Adams | 273/123 R |
| 1,685,586 | A | * | 9/1928 | Guinzburg | 2/175.3 |
| 2,630,654 | A | * | 3/1953 | Poen | 446/49 |
| 3,479,668 | A | * | 11/1969 | Bigler | 2/175.2 |
| 4,492,380 | A | * | 1/1985 | Saytar | 273/400 X |
| 4,588,149 | A | * | 5/1986 | Gold | 244/145 |
| 4,889,347 | A | * | 12/1989 | Mineart | 473/588 |
| 5,098,109 | A | * | 3/1992 | Wayne | 273/400 |
| 5,217,230 | A | * | 6/1993 | Judd | 273/400 X |
| 5,322,097 | A | * | 6/1994 | Wright | 141/199 |
| 5,388,787 | A | * | 2/1995 | Webb et al. | 244/142 |
| 5,725,444 | A | * | 3/1998 | Heden | 273/400 X |
| 5,913,409 | A | * | 6/1999 | Test | 2/102 |
| D418,894 | S | * | 1/2000 | Kue | D21/811 |
| 6,129,635 | A | * | 10/2000 | Kuo | 472/49 |

OTHER PUBLICATIONS

Gail Szautner. "Parachute Play". Interaction, Canadian Child Care Federation, Summer 1994 [online], [retrieved on Jul. 27, 2002]. Retrieved from the internet: <URL:http//www.cfc–efc.ca/docs/cccf/0004_en.htm>.*

"Ball Roll". Games & Outdoors: Parachute, added Jul. 25, 2000[online], [retrieved on Jul. 27, 2002]. Retrieved from the internet: <URL:http://www.preschooleducation.com/gparachute.shtml>.*

Porthole Parachute and Grip Star Chutes, ("Sportime elementary" 2000 Spring catalog, Sportime, L.L.C.) cover page and pp. 114 and 115 attached.

* cited by examiner

*Primary Examiner*—Raleigh W. Chiu
(74) *Attorney, Agent, or Firm*—Synnestvedt & Lechner LLP

(57) ABSTRACT

An amusement device including a sheet of flexible material defining an opening, and a pocket defining a mouth joined to the sheet around the opening. The sheet is grasped by participants during a game in which the sheet is held substantially horizontally and selectively tilted to maneuver a ball along the sheet, through the opening, and into the pocket. In one embodiment, the amusement device includes first and second sheets of flexible material joined along their respective longitudinal edges. Each sheet defines an opening. A pocket may optionally be joined to the sheet around each opening. A game may be played by opposing teams, each of which guards the opening on its sheet, and attempts to guide the ball into the opening on the opposing team's sheet. A game including an amusement device and a ball is also provided.

18 Claims, 5 Drawing Sheets

FIG.1
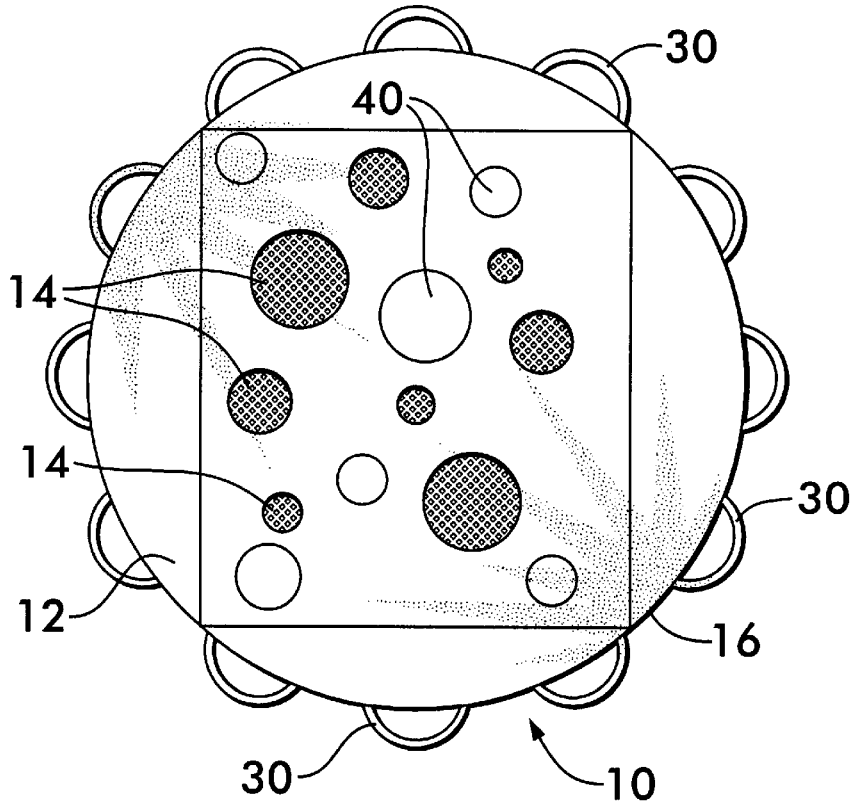
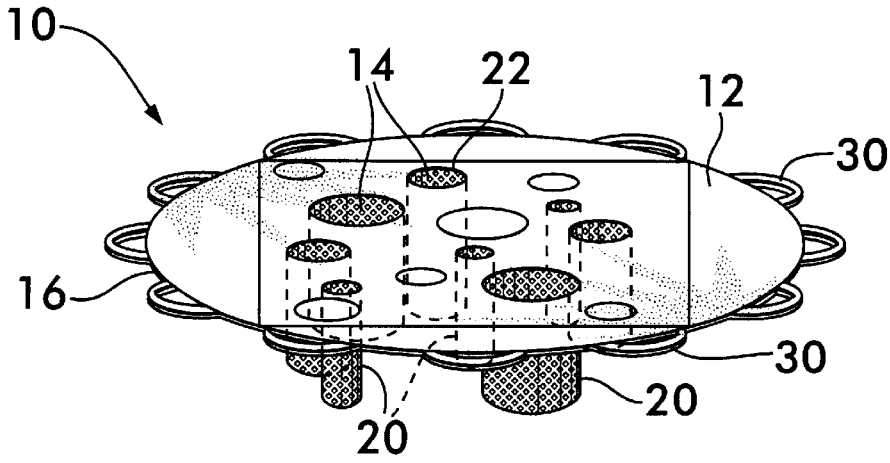
FIG.2

FIG.3
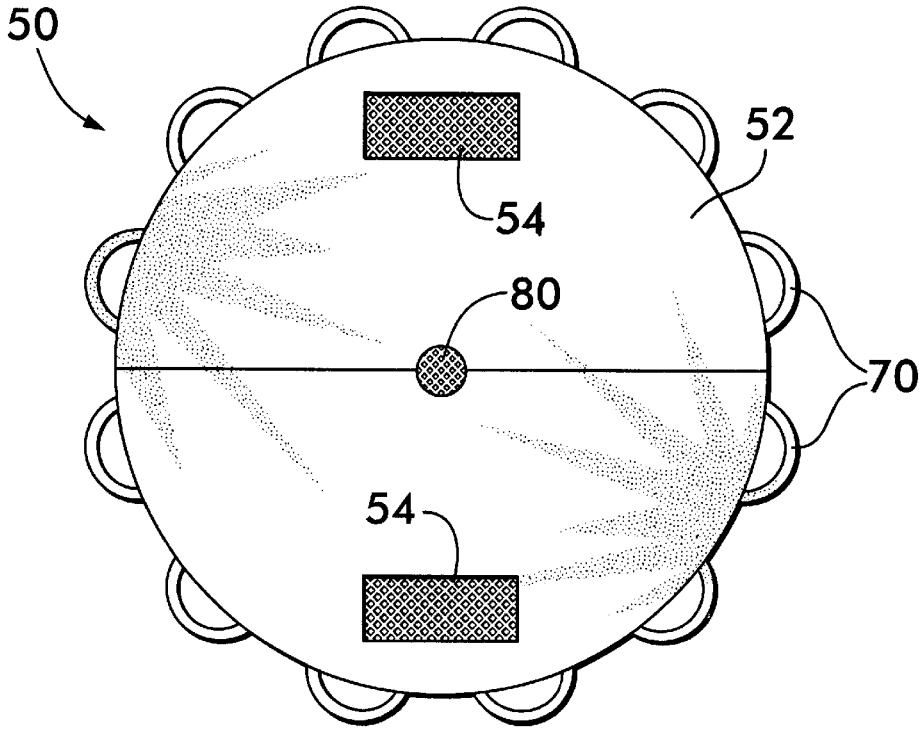
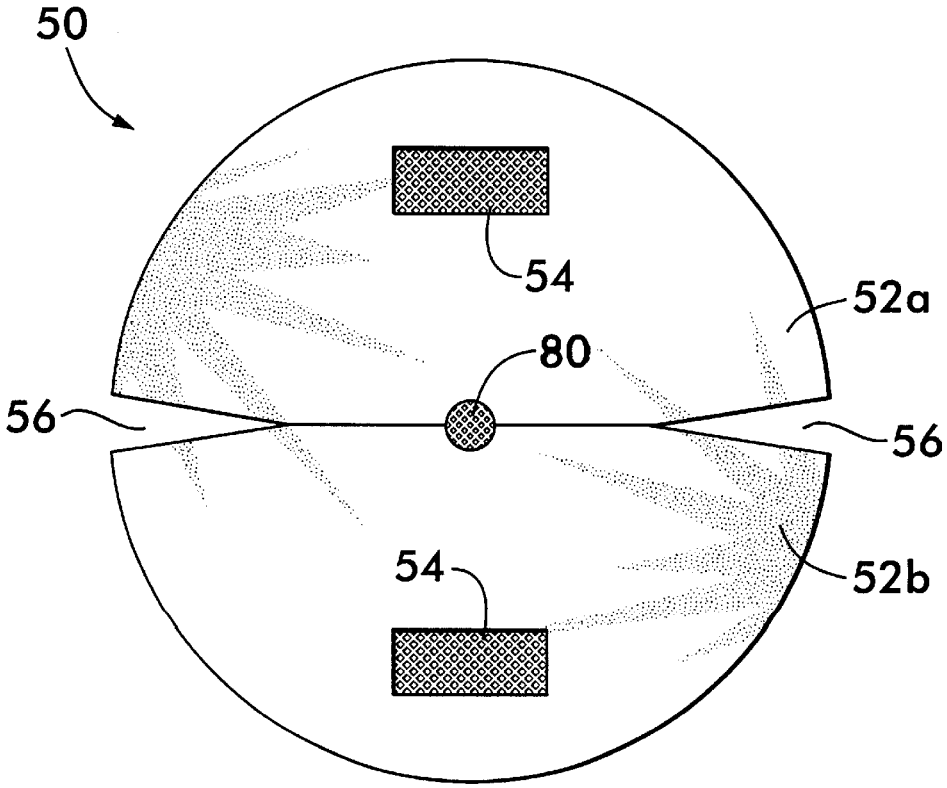
FIG.4

FIG.5
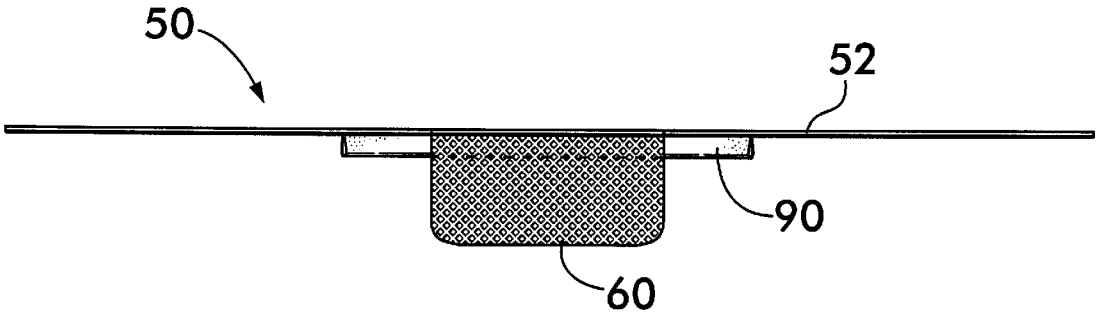
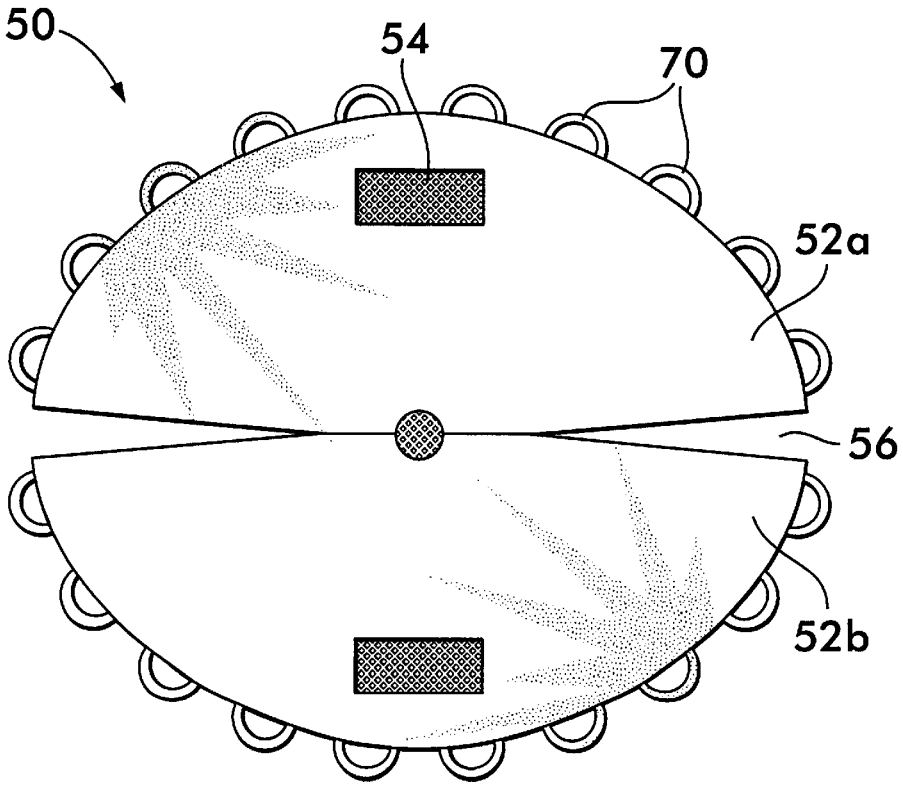
FIG.6

POCKETED PARACHUTE GAME

RELATED APPLICATIONS

This application claims the benefit of U.S. Provisional Patent Application No. 60/150,483, filed Aug. 24, 1999, and U.S. Provisional Patent Application No. 60/226,225, filed Aug. 18, 2000, the disclosures of which are hereby incorporated herein by reference.

FIELD OF THE INVENTION

The present invention relates to an amusement device and, more particularly, to a "parachute" game in which the users of the device attempt to direct a playing piece into holes formed in the device.

BACKGROUND OF THE INVENTION

Parachutes of various configurations are well known for creating wind resistance to slow an object's movement. Parachute-type amusement devices for use as a toy are also known. Such devices have typically been popular with elementary-school aged children. In one popular game, children grab the parachute around its periphery, hold the parachute essentially horizontally, and collectively jerk the parachute upwardly and downwardly to cause the parachute to billow with air. While air escapes beneath the parachute or through a centrally located vent, the children may take shelter beneath the parachute, etc. While such a toy may be fun for younger children, it lacks appeal for older children and adults, and further lacks a cooperative or a competitive nature which is desirable for many games. Games having such natures teach leadership, communication, goal sharing, and problem solving.

SUMMARY OF THE INVENTION

The present invention provides an amusement device including a sheet of flexible material defining an opening, and a pocket defining a mouth joined to the sheet around the opening. In one embodiment, the sheet defines multiple openings and has multiple pockets. Optionally, the sheet may have handles secured around its periphery to be grasped by participants during a game in which the sheet is held substantially horizontally and selectively tilted to maneuver a ball along the sheet, through one of the openings, and into a pocket.

In another embodiment of the invention, the amusement device includes a first and second sheet of flexible material joined along their respective longitudinal edges. Each sheet defines an opening. A pocket may optionally be joined to the sheet around each opening. This sheet may be used by a participant to play a game involving guiding a ball into an opening. The game may be played by opposing teams, each of which guards the opening on its sheet, and attempts to guide the ball into the opening on the opposing team's sheet.

A game including an amusement device and a ball is also provided.

DESCRIPTION OF THE DRAWINGS

FIG. 1 is a top view of an amusement device in accordance with a first embodiment of the present invention;

FIG. 2 is a perspective view of the amusement device in FIG. 1;

FIG. 3 is a top view of an amusement device in accordance with a second embodiment of the present invention;

FIG. 4 is a top view of an alternate embodiment of the amusement device shown in FIG. 3;

FIG. 5 is a side view of the amusement device shown in FIG. 4;

FIG. 6 is a top view of another alternate embodiment of the amusement device shown in FIG. 3.

DETAILED DESCRIPTION

Figure 7:
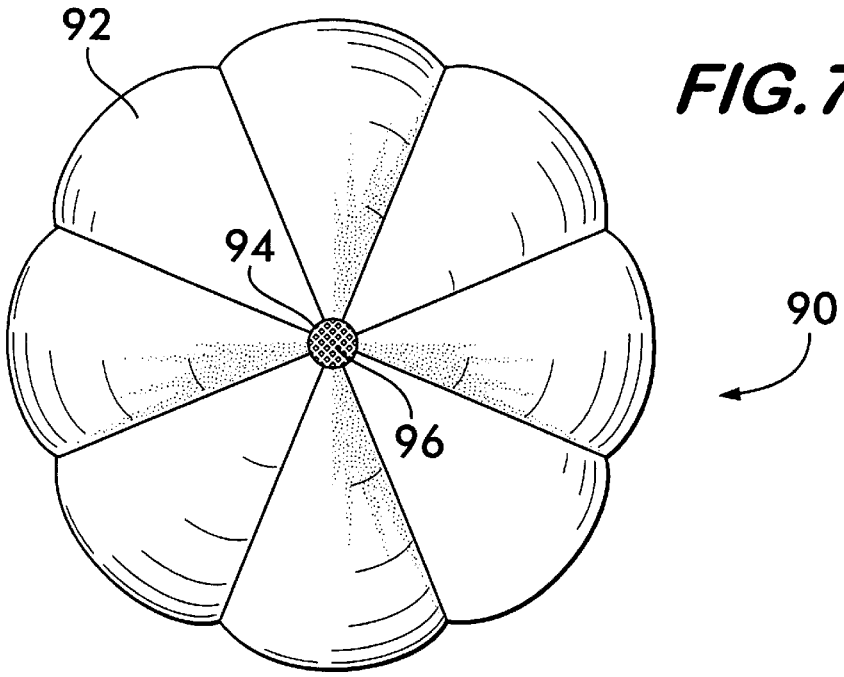
FIG. 7 is a top view of a vented parachute.

The present invention provides a parachute-type amusement device. A first embodiment of the parachute-type amusement device is shown in FIGS. 1 and 2. As shown in FIGS. 1 and 2, the device 10 includes a sheet of material 12 defining a plurality of openings 14 arranged erratically about the sheet 12. The sheet 12 is preferably circular is shape and is preferably a lightweight material such as a nylon fabric. In one embodiment, all openings 14 are circular and have the same diameter. In another embodiment, the openings 14 have diameters of different sizes.

Preferably, pockets 20 are joined to the sheet 12. Each pocket defines a mouth 22 which is joined to the sheet 12 around each opening 14, as shown in FIG. 2. Accordingly, any object passing through an opening 14 will be caught in a pocket 20. The pockets may be constructed of any suitable material. In a preferred embodiment, the pockets are made of a mesh material so that any object contained by the pockets is easily visible.

Handles 30 are positioned along the outer perimeter 16 of the sheet 12 for a game participant to grasp. In one embodiment, the handles 30 are integrally formed with the sheet 12. In other words, a portion of the sheet 12 is removed to define a handle 30. In another embodiment, the handles 30 are stitched to the sheet 12.

In a preferred embodiment, decoy holes 40 are printed on the sheet of material 12. In this manner, the overall appearance of the sheet 12 is made to resemble a piece of swiss cheese, with the openings 14 and decoy holes 40 having the appearance of the holes commonly found in swiss cheese.

A playing piece, such as a ball, is utilized by participants playing with the device 10. Participants grasp the handles 30 to hold the sheet 12 essentially horizontally. In this manner, the sheet 12 defines a playing surface. The ball is placed on the sheet 12 and the participants use the handles 30 to selectively raise and lower portions of the sheet 12 to maneuver the ball into an opening 14. The game can be a team game in which players of the same team try to earn points by maneuvering a ball into an opening 14 while the other team tries to keep the ball out of the opening. Alternatively, all players can play cooperatively as a single team, trying to sequentially maneuver a ball or a group of balls into the openings in a predetermined sequence. The openings 14 may be numbered so that the sequence is clearly visible to all players. In an embodiment in which the openings 14 vary in diameter, directing the ball into a smaller opening may result in a higher point score.

A second embodiment of the parachute-type amusement device is shown in FIGS. 3–6. This device 50 includes a sheet of material 52 defining a plurality of openings 54 arranged about the sheet of material 12. The sheet 52 is preferably circular in shape. FIG. 6 shows an alternate embodiment in which the sheet is oval in shape. In one embodiment, the sheet 52 is formed as a single solid sheet, as shown in FIG. 3. In another embodiment, the sheet 52 has a pair of slits 56 extending partially inwardly from the periphery 54 along a diameter, as shown in FIGS. 4–6. For a sheet of material 18–24 feet in diameter, slits 56 approximately 6–8 feet in length and rectangular openings two feet wide and three feet long have been found suitable. In this embodiment, the sheet may be formed by slitting a single sheet of material or by joining together two separate semi-circular sheets 52*a*, 52*b*, e.g., by stitching. For example, it may be advantageous to use semi-circular sheets of different colors. The sheet may optionally be reinforced, e.g., by stitching, adjacent the slits 56 to prevent tearing or separation of the semi-circular sheets 52*a*, 52*b*.

For a circular sheet 52, the openings 54 are preferably arranged along a diameter perpendicular to an axis defined by the slits 56. For a non-circular sheet, the openings are preferably arranged along a minor axis of the sheet of material 52 and adjacent the periphery 54.

Preferably, pockets 60 are joined to the sheet 52 around each opening 54 as shown in FIG. 5. In this manner, the pockets define a "goal". Accordingly, any object passing through an opening 54 will be caught in a pocket 60. The pockets 60 are preferably at least two feet deep and are made of a mesh material so that any object contained by the pockets is easily visible. Handles 70 are positioned along the outer perimeter of the sheet of material 52 for a game participant to grasp.

In one embodiment, the sheet 52 includes a centrally located mesh panel 80 to mark a center point of the sheet 52. The mesh panel 80 is preferably attached to the sheet of material 52 to lie in substantially the same plane as the sheet of material 52. The mesh panel provides an opening for air to pass through the sheet 52 and also marks a center point for placement of a playing piece while playing a game. For example, a mesh insert 18 inches in diameter has been found suitable.

Optionally, the amusement device 50 may include a sleeve 90 extending from an 110 underside of the sheet 52, as shown in FIG. 5. If desired, a rope, etc. may be passed through the sleeve 90 and connected at each end to a stanchion, etc. to anchor or limit the mobility of the amusement device 50 relative to the ground.

A playing piece, such as a ball, is utilized by the game participants. The game participants grasp the handles 70 to hold the sheet 52 essentially horizontally service begins by placement of the ball in the center of the sheet 52, e.g., on the mesh panel 80. Game participants then use the handles 70 to selectively raise and lower portions of the sheet of material 52 to maneuver the ball into an opposing team's opening 54 to score a point. The slits 56 separate the sheet of material 52 so that individual teams may manipulate the sheet 52 independently. Members of a team may "pass" to one another to set up a teammate for a shot into the opposing team's pocket 60 to score a point. The game may optionally be played similarly to volleyball with respect to scoring and loss of service. The game is therefore a competitive team game which is appealing to many older children and adults.

Figure 8:
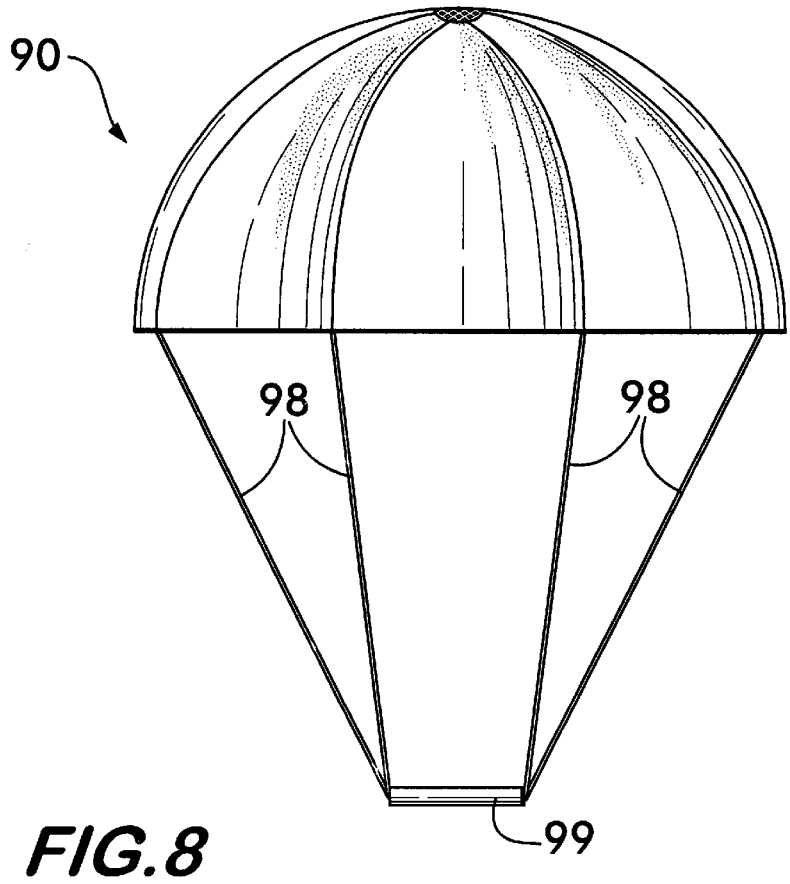
FIG. 8 is a side view of the vented parachute of FIG. 7.
Figure 9:
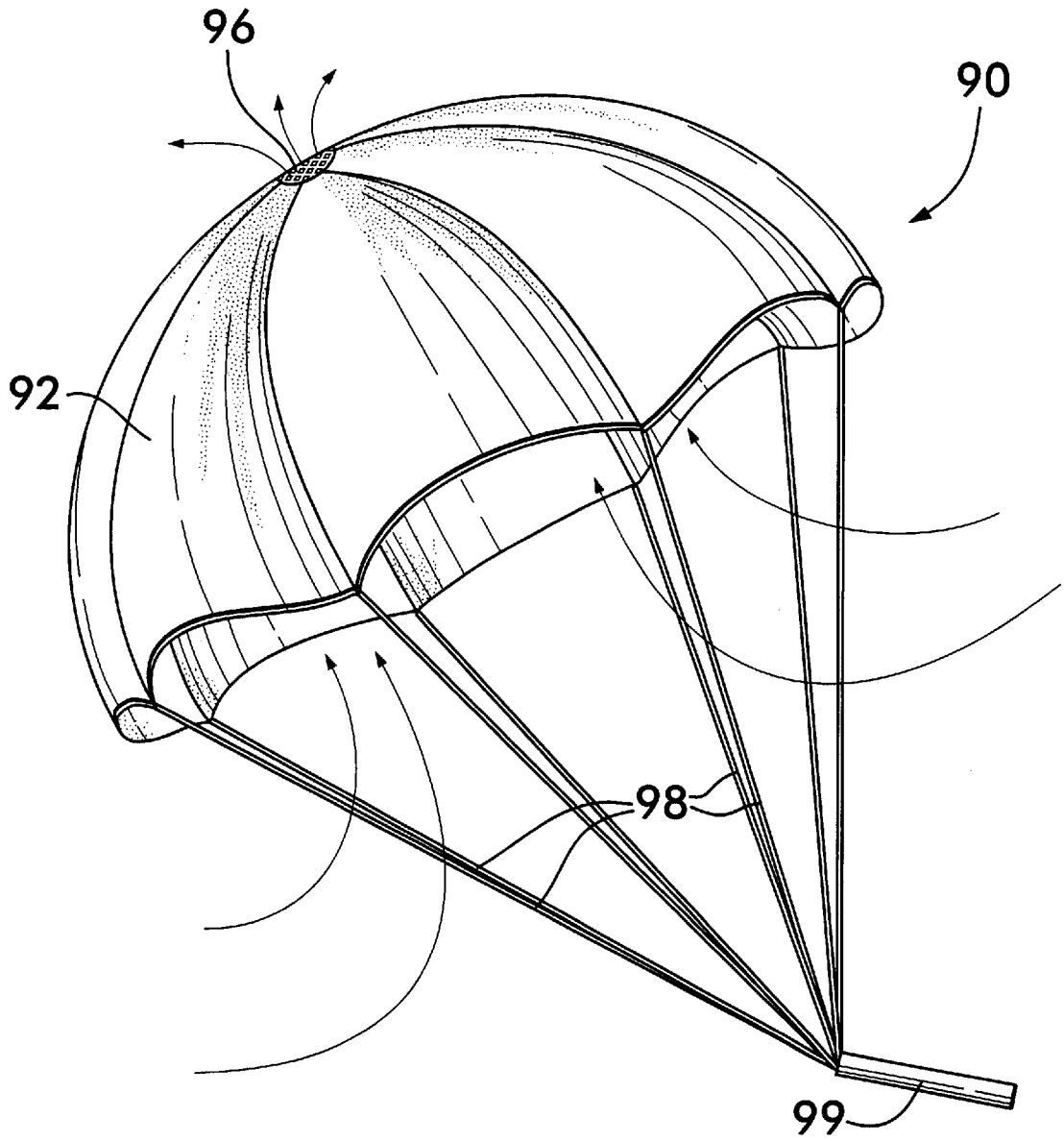
FIG. 9 is a perspective view of the vented parachute of FIG. 7.

FIGS. 7–9 show a vented parachute 90 including a sheet 92 defining a central opening 94. The opening 94 is covered by a mesh panel 96 attached to the sheet 92. The sheet 92 is joined by strings 98 to handle 99. The vented parachute 90 can be used to "scoop" up air, causing the sheet 92 to billow. Air escapes slowly through mesh panel 96, thereby providing resistance to a participant maneuvering the handle 99. This provides upper-body exercise and improves the participant's coordination and dexterity.

Having thus described particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. For example, there is no limitation as to the number of openings 14, 54 or to their size. Further, although the devices 10, 50 as shown are circular or oval in shape, they can be any shape desired. Additionally, the sheet could define multiple slits to provide multiple playing surfaces.

Accordingly, the foregoing description is by way of example only, and not limiting. The invention is limited only as defined in the following claims and equivalents thereto.

What is claimed is:

1. An amusement device for use by multiple participants, comprising:

a flexible sheet having an outer perimeter, said sheet being of sufficient size to be grasped around said outer perimeter by said multiple participants;

said sheet being made of a material capable of acting substantially as a parachute for retarding the movement of the device through air, said sheet having a pair of opposing slits extending partially inwardly from said perimeter toward a center of said sheet of material; and at least one opening disposed in said flexible sheet, said opening having a pocket capable of catching a ball falling through said opening.

2. The device of claim 1 comprising a plurality of said openings.

3. The device of claim 2 wherein said openings are arranged erratically on said sheet.

4. The device of claim 2 wherein said openings have diameters of different sizes.

5. The device of claim 1 wherein said pocket is made of a mesh material so that an object therein is easily visible.

6. The device of claim 1, wherein said sheet comprises a non-mesh of nylon and said pocket comprises a mesh material so that an object therein is easily visible.

7. The device of claim 1 further comprising multiple handles attached to said device around said perimeter for use by said multiple participants.

8. The device of claim 7 wherein said handles extend from said sheet to be hand grippable by said participants separate from said sheet.

9. The device of claim 7 wherein said handles are stitched to said flexible sheet.

10. The device of claim 1 further comprising a ball for use with said sheet, said ball being sized to be capable of passing through said opening into said pocket.

11. A method of playing a game, comprising:

providing the parachute device in accordance with claim 1;

providing a ball on top of said sheet; and manipulating said sheet to direct said ball into the opening, said manipulating being carried out by said participants.

12. An amusement device for use by multiple participants, comprising:

a flexible sheet having an outer perimeter, said sheet being of sufficient size to be grasped around said outer perimeter by said multiple participants;

said sheet being made of a material capable of acting substantially as a parachute for retarding the movement of the device through air, said sheet further comprising an image of at least one decoy hole positioned on said sheet of material; and at least one opening disposed in said flexible sheet, said opening having a pocket capable of catching a ball falling through said opening.

13. An amusement device for use by multiple participants, comprising:

a flexible sheet having an outer perimeter, said sheet being of sufficient size to be grasped around said outer perimeter by said multiple participants;

said sheet being made of a material capable of acting substantially as a parachute so as to billow with air in response to manipulation of said sheet by said participants; and multiple openings disposed in said flexible sheet, each of said openings having a pocket capable of catching a ball falling through said opening.

14. The device of claim 13, wherein said sheet has a pair of opposing slits extending partially inwardly from said perimeter toward a center of said sheet of material.

15. The device of claim 13 further comprising multiple handles attached to said device around said perimeter for use by said multiple participants.

16. The device of claim 15 wherein said handles extend from said sheet to be hand gripable by said participants separate from said sheet.

17. The device of claim 13 further comprising a ball for use in combination with said sheet, said ball being sized to be capable of passing through said opening into said pocket.

18. The device of claim 13 further comprising an image of at least one decoy hole positioned on said sheet of material.

* * * * *